US007849573B2

(12) United States Patent
Saathoff, Sr.

(10) Patent No.: US 7,849,573 B2
(45) Date of Patent: Dec. 14, 2010

(54) APPARATUS FOR SELF-PIERCING RIVET

(75) Inventor: Donald Saathoff, Sr., Maybee, MI (US)

(73) Assignee: Ford Motor Company, Dearborn, MI (US)

( * ) Notice: Subject to any disclaimer, the term of this patent is extended or adjusted under 35 U.S.C. 154(b) by 1132 days.

(21) Appl. No.: 11/530,187

(22) Filed: Sep. 8, 2006

(65) Prior Publication Data

US 2008/0066286 A1 Mar. 20, 2008

(51) Int. Cl.
*B23P 11/00* (2006.01)

(52) U.S. Cl. ..... 29/243.53; 29/432.1; 29/524.1; 29/525.06; 29/798

(58) Field of Classification Search ..... 29/243.53, 29/432.1, 524.1, 525.06, 798
See application file for complete search history.

(56) References Cited

U.S. PATENT DOCUMENTS 4,449,428 A * 5/1984 Francis ..... 76/104.1
4,555,838 A * 12/1985 Muller ..... 29/432.1
4,765,057 A * 8/1988 Muller ..... 29/716
5,046,228 A 9/1991 Eckold et al.
5,617,619 A 4/1997 Knudson
5,752,305 A * 5/1998 Cotterill et al. ..... 29/432.2
6,325,584 B1 12/2001 Marko et al.
6,546,613 B2 4/2003 Donovan
6,663,329 B2 12/2003 Singh et al.
6,692,213 B1 * 2/2004 Butler ..... 414/412
7,487,583 B2 * 2/2009 Craythorn et al. ..... 29/809
2003/0037420 A1 * 2/2003 Kato ..... 29/243.53
2005/0019137 A1 1/2005 Iwatsuki et al.
2005/0086799 A1 4/2005 Kato et al.

FOREIGN PATENT DOCUMENTS

CN 1485163 3/2004
GB 2417452 1/2006

OTHER PUBLICATIONS

Chinese Office Action dated Mar. 10, 2010 for Chinese Patent Application No. 200710147694.1.
Search Report under Section 17(5) for Application GB0715997.3 dated Nov. 27, 2007.

* cited by examiner

*Primary Examiner*—Paul D Kim
(74) *Attorney, Agent, or Firm*—Raymond L. Coppiellie; Brooks Kushman P.C.

(57) ABSTRACT

An apparatus for riveting two or more sheets together that includes a punch and a die. The die has an expandable cavity that is formed by a tip and a plurality of movable blades. The blades are retained on the die, in part, by an elastomeric blade collar that biases the blades inwardly toward the tip. A method of riveting a plurality of sheets together with the apparatus is also disclosed.

15 Claims, 2 Drawing Sheets

APPARATUS FOR SELF-PIERCING RIVET

BACKGROUND OF THE INVENTION

1. Field of the Invention

The invention relates to an apparatus and method for riveting two or more sheets together using a self-piercing rivet.

2. Background Art

Self-piercing rivets are used in many industries because they provide a relatively simple one-step technique for joining metal sheets together. Presently, self-piercing rivet tools use a die with solid non-moveable parts to form a rivet that is used to join metal sheets. Self piercing rivets are secured in a cold forming process in which a semi-tubular rivet is pressed into overlapping metal sheets to mechanically fasten the metal sheets together. More specifically, the rivet pierces through an upper metal sheet and then embeds into a lower metal sheet to join the metal sheets. Self-piercing rivets do not require forming a hole in the metal sheets before riveting.

Manufacturers are adopting thinner and stronger materials to reduce the weight of manufactured products. The use of self-piercing rivets to fasten metal sheets made of stronger materials, such as high-strength low-alloy (HSLA) steel, creates challenges. One of the challenges to riveting stronger materials is that increased pressure is required to drive and deform the rivets. The pressure developed within the die cavity increases as the rivet is driven into the metal sheets. Increased pressure applied within the cavity during the riveting process causes increased resistance to penetration by the rivet. To overcome this resistance, the concept has been proposed to increase the strength of the cylindrical shaft of the rivet. Higher strength rivets are more expensive and more difficult to install. The increased pressure within the cavity also limits the types of self-piercing rivets that can be used in the self-piercing riveting process. In effect, increased pressure in the cavity substantially limits the range of materials that can be fastened together by self-piercing rivets.

The invention addresses one or more of the above problems and limitations as summarized below.

SUMMARY OF THE INVENTION

One aspect of the present invention is to provide an apparatus for riveting two or more sheets together using a die that has a plurality of movable blades that reduce the pressure generated within a cavity of the die as a self-piercing rivet penetrates the sheets. The reduced pressure generated within the cavity broadens the range of different types of self-piercing rivets that may be used in a self-piercing riveting process. In addition, reduced pressure in the die allows manufacturers to rivet higher strength materials, such as high-strength low-alloy (HSLA) steel, dual-phase (DP) steel and other exotic materials. The present invention may be used to rivet two or more different types of materials, such as, for example, a steel sheet and an aluminum sheet.

The metal sheets are riveted together using a tool having a punch and a die. The tool may support the punch and the die that are attached to opposing ends of the C-shaped frame. The die has a rounded tip portion, a circular platform portion, and a lip portion. The tip portion controls deformation of a self-piercing rivet and is contiguous with the circular platform portion. The platform portion extends radially outward from the bottom of the tip portion to limit downward deformation of the metal sheets. The lip portion extends radially outward from the die to retain the blades on a top surface of a base portion of the die. The top surface also limits movement of the blades toward the base portion.

The plurality of blades are assembled around the tip portion and the lip portion. The blades allow the sheets to deform radially outward from the tip portion as a portion of the sheets are locally formed against the die and the rivet penetrates into the sheets. The blades may be adjacent to the top surface of the base portion and may include an inner notch that receives the lip portion of the die.

A blade collar resiliently biases the blades inwardly towards the tip portion. The blade collar may be radially disposed around an intermediate portion of the die and a circular relief cavity. The blade collar retains the blades when the punch drives the rivet into the metal sheets. In addition, the blades may include an outer notch facing radially outward from the longitudinal axis of the die. The notch is disposed above the lip portion of the intermediate portion and receives the blade collar.

The intermediate portion includes the portion of the die located between the tip portion and the base portion and is coaxial with and adjacent to both the tip portion and the base portion. The intermediate portion includes both the platform portion and the lip portion. The blades are assembled around the intermediate portion. The intermediate portion may include a radially beveled recess that receives a radially beveled blade lip of the blades. The blade lip retains the blades on the top surface of the base portion. In addition, the base portion and the recess may form a radially beveled channel that receives the blade lip.

The intermediate portion, the rounded tip portion, and the blades define the circular relief cavity. The relief cavity provides space for local deformation of the sheets when the punch drives the rivet into the sheets. Local deformation occurs at the mating portions of the sheets that are deformed between the punch and the die. Deformation of the mating portion into the relief cavity causes the blades to move radially outward from the tip portion which expands the relief cavity. In addition, the relief cavity may expand down towards the lip portion of the intermediate portion when the blades move radially outward from the tip portion.

Another aspect of the present invention is to provide a method for riveting sheets with a die that has a plurality of movable blades. The sheets are first arranged between the punch and the die. The punch then drives the self-piercing rivet towards the sheets and forces the rivet through the sheets. A hollow tubular portion of the rivet shears a first portion of a first sheet and then penetrates a second sheet of the sheets. When the rivet penetrates the second sheet, the second sheet is deformed into the relief cavity. In addition, the rounded tip portion facilitates deformation of the sheets. A blade collar is received into the outer notch of the blades and biases the blades toward the die. When the blades move radially outward from the longitudinal axis of the die, the blade collar also expands radially outward relative to the longitudinal axis of the die to open the relief cavity and the reduce pressure within the relief cavity. The hollow tubular portion of the rivet spreads radially outward from the longitudinal axis of the rivet and into the second sheet to fasten the sheets together.

Other aspects of the invention will be better understood in view of the attached drawings, and the following detailed description of the illustrated embodiment.

DETAILED DESCRIPTION OF THE PREFERRED EMBODIMENT(S)

Figure 1:
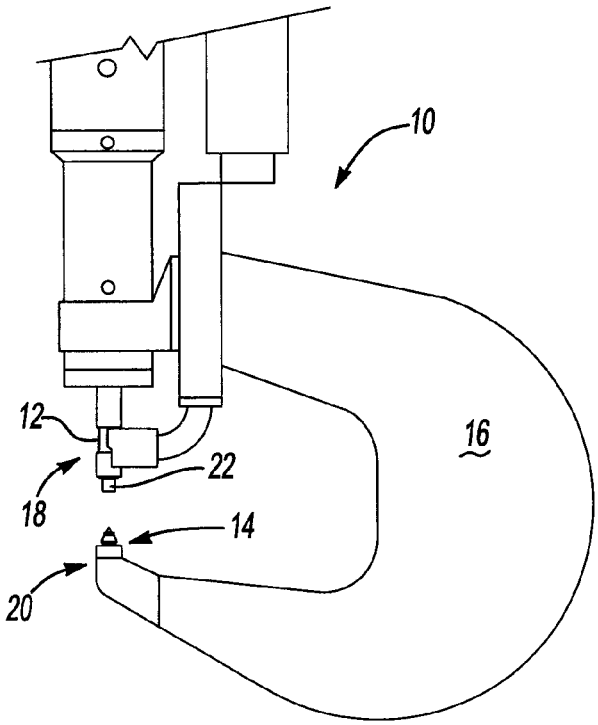
FIG. 1 is a side elevational view of a riveting tool having a punch and a die disposed on opposing ends of a C-shaped frame.

With reference to FIG. 1, a riveting tool 10 is shown that includes a punch 12 and a die 14. The tool 10 may include a C-shaped frame 16. The punch 12 and die 14 are attached to opposing ends of the C-shaped frame 16. The punch 12 is attached to a first end 18 of the C-shaped frame 16. The die 14 is attached to a second end 20 of the C-shaped frame 16 that faces the punch 12. A self-piercing rivet 22 is positioned between the punch 12 and the die 14. The punch 12 is used to drive the rivet 22 toward and into two or more metal sheets 24 as will be described with reference to FIGS. 3-6 below. While the typical application for self-piercing riveting is the joining of metal sheets, it is also possible to join non-metal sheets together or to a metal sheet.

Figure 2:
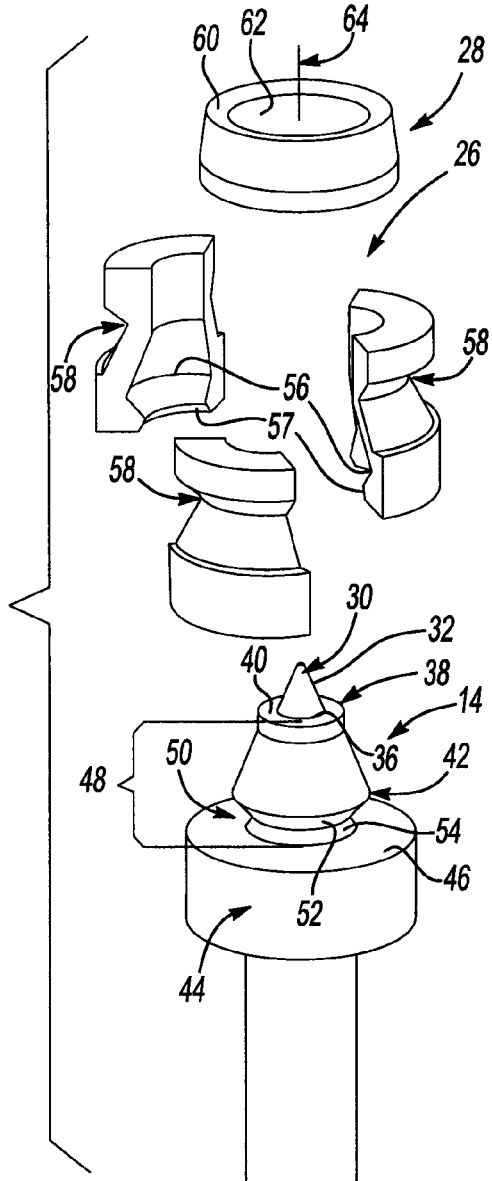
FIG. 2 is an exploded perspective view of the die, a plurality of blades, and a blade collar.

FIG. 2 illustrates the structure and arrangement of the die 14, a plurality of blades 26, and a blade collar 28. The die 14 has a rounded tip portion 30 that controls deformation of the rivet 22. The tip portion 30 may include an external partially conical surface 32. The external surface 32 tapers radially inwardly along the longitudinal axis 34 of the die 14 in the direction of the punch 12. The tip portion 30 has a bottom end 36. The bottom end 36 is contiguous with a circular platform portion 38 of the die 14. The platform portion 38 limits downward deformation of the metal sheets 24. The platform portion 38 extends radially out from the bottom end 36 of the tip portion 30 and forms a relatively flat surface 40 facing the punch 12. The die 14 has a lip portion 42 that is contiguous with and is positioned below the platform portion 38 and extends radially outward from the longitudinal axis 34 of the die 14. In addition, the die 14 has a base portion 44 that includes a top surface 46.

Die 14 has an intermediate portion 48 that is defined by the portion of the die 14 located between the tip portion 30 and the base portion 44. The intermediate portion 48 is coaxial with and adjacent to both the tip portion 30 and the base portion 44. The intermediate portion 48 includes both the platform portion 38 and the lip portion 42 of the die 14. In addition, the intermediate portion 48 may include a radially beveled recess 50. The recess 50 may be formed by an upper recess surface 52 and a lower recess surface 54. Both the upper recess surface 52 and the lower recess surface 54 taper radially inward towards each other to form the recess 50 of the intermediation portion 48. In addition, the base portion 44 and the upper recess surface 52 form a radially beveled channel 55.

Figures 3, 4, 5:
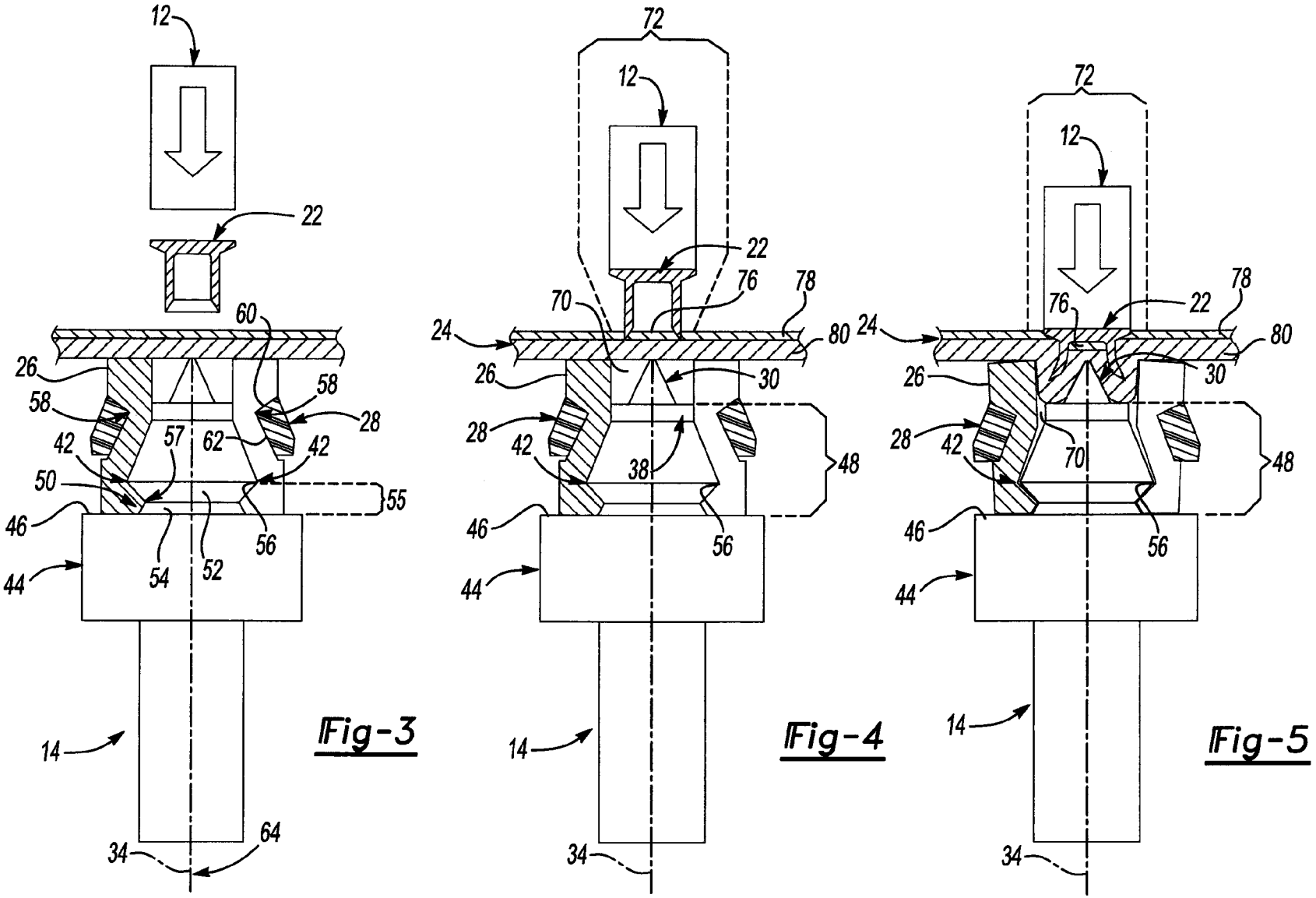
FIG. 3 is a diagrammatic cross-sectional view of a riveting tool that illustrates the position of the punch and a self-piercing rivet relative to the die and the blades before beginning the riveting process.
FIG. 4 is a cross-sectional view of the riveting tool similar to FIG. 3 illustrating the rivet just prior to piercing.
FIG. 5 is a cross-sectional view of the riveting tool similar to FIG. 3 illustrating penetration of the self-piercing rivet into the sheets with the blades being expanded outward from the longitudinal axis of the die and with the blades being retained by the blade collar.

With reference to FIGS. 2 and 3, the blades 26 may include an inner notch 56. The inner notch 56 receives the lip portion 42 to retain the blades 26 on the top surface 46 of the base portion 44. The top surface 46 limits movement of the plurality of blades 26 toward the base portion 44. The blades 26 may also have a radially beveled blade lip 57. Blade lip 57 is received into the beveled recess 50 to retain the blades 26 on the top surface 46 of the base portion 44. Also, the blade lip 57 may be received into the beveled channel 55 between the upper recess surface 52 and the base portion 44. Blades 26 may include an outer notch 58 that faces radially outward from the longitudinal axis 34 of the die 14 and is disposed above the lip portion 42.

Blade collar 28 biases the blades 26 toward the longitudinal axis 34 of the die 14. Blade collar 28 may have an upper inner circular surface 60 and a lower inner circular surface 62. Both the upper inner circular surface 60 and the lower inner circular surface 62 are received within the outer notch 58 of the blades 26. The lower inner circular surface 62 generally tapers radially inward from the longitudinal axis 64 of the blade collar 28 and towards the upper inner circular surface 60. The upper inner circular surface 60 generally tapers towards the lower inner circular surface 62 and radially inward from the longitudinal axis 64 of the blade collar 28. The blade collar 28 may be formed of an elastomeric polymer.

With reference to FIGS. 4 and 5, the plurality of blades 26 are assembled around the intermediate portion 48. The blades 26 may be adjacent to the top surface 46 of the base portion 44. The blades 26 allow the metal sheets 24 to deform radially outward from the tip portion 30 as the rivet 22 penetrates into the metal sheets 24 that are deformed towards the die 14. The blade collar 28 may be radially disposed around the platform portion 38 and the lip portion 42. The blade collar 28 resiliently biases the blades 26 inwardly towards the tip portion 30. The blade collar 28 limits the movement of the blades 26 radially outward from the tip portion 30 to retain the blades 26 on the top surface 46 of the base portion 44. The intermediate portion 48, the rounded tip portion 30, and the blades 26 define a circular relief cavity 70. The relief cavity 70 provides space for local deformation of the metal sheets 24 and the rivet 22 when the punch 12 drives the rivet 22 into the metal sheets 24. Local deformation occurs at a mating portion 72 of the metal sheets 24 which is defined as the portion of the metal sheets 24 that is acted upon by the punch 12 and the die 14.

FIGS. 3 through 5 illustrate a sequential series of steps of the riveting process. As shown in FIG. 3, the metal sheets 24 are arranged between the punch 12 and the die 14. The punch 12 drives the self-piercing rivet 22 towards the metal sheets 24.

As shown in FIG. 4, a hollow tubular portion 74 of the rivet 22 shears a first portion 76 of a first sheet 78 of the metal sheets 24 before penetrating a second sheet 80 of the metal sheets 24.

As shown in FIG. 5, when the rivet 22 penetrates the second sheet 80, the second sheet 80 is deformed into the relief cavity 70. The rounded tip portion 30 controls deformation of the metal sheets 24 and the rivet 22. As the mating portion 72 is deformed into the relief cavity 70 the blades 26 are caused to move radially outward from the tip portion 30. The blades 26 move radially outward relative to the longitudinal axis 34 of the die 14 that causes the blade collar 28 to expand radially outward from the longitudinal axis 34 of the die 14. Radial outward movement of the blades 26 expands the relief cavity 70 to reduce the reaction force applied by the blades 26 to the mating portion 72 as it is deformed into the relief cavity 70. In addition, the relief cavity 70 may expand down towards the lip portion 42 of the intermediate portion 48 when the blades 26 move radially outward from the tip portion 30. The lip portion 42 of the die 14 fits into the inner notch 56 of the blades 26 to retain the blades 26 on the die 14 when the blades 26 move outward from the longitudinal axis 34 of the die 14.

The hollow tubular portion 74 of the rivet 22 spreads radially outward from the longitudinal axis 82 of the rivet 22 and into the second sheet 80 to mechanically fasten the metal sheets 24 together. The rounded tip portion 30 facilitates spreading the hollow tubular portion 74 of the rivet 22 into the metal sheets 24. Removal of the metal sheets 24 from the blades 26 and the exterior surface 32 after the spreading the hollow tubular portion 74 of the rivet 22 is facilitated as a result of the blades 26 being spread apart during the riveting process.

Figure 6:
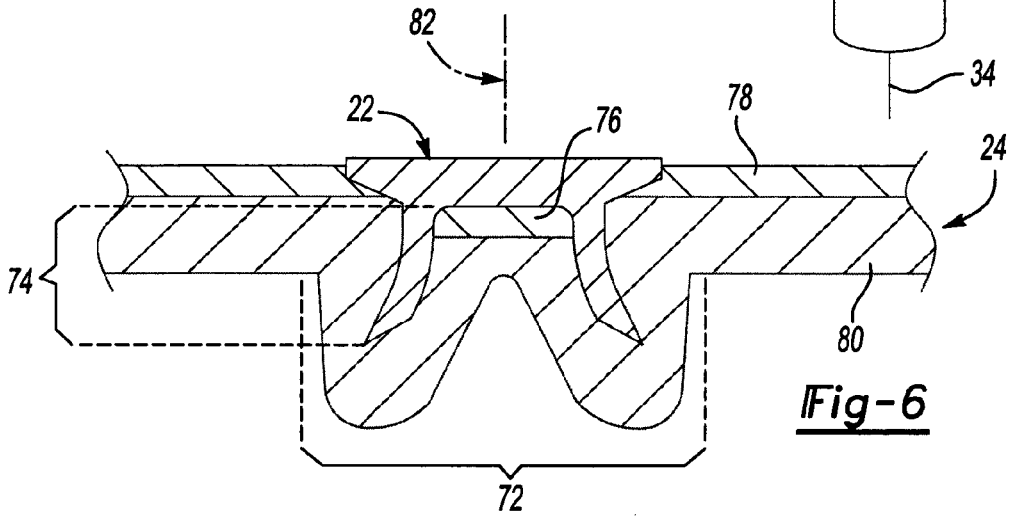
FIG. 6 is an enlarged cross-sectional view that illustrates the rivet after piercing through the first sheet with the hollow tubular portion of the rivet spread radially outward from the longitudinal axis of the rivet and into a second sheet.

FIG. 6 shows the first sheet 78 and the second sheet 80 riveted together by the rivet 22. The hollow tubular portion 74 of the rivet 22 pierces through the first sheet 78 and embeds into the second sheet 80. The first portion 76 of the first sheet 78 is removed from first sheet 78 and lodged within the hollow tubular portion 74. The hollow tubular portion 74 is spread radially outward from the longitudinal axis 82 of the rivet 22 and into the mating portion 72 of the metal sheets 24.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. An apparatus for riveting two or more sheets together, comprising:

a punch for driving a self-piercing rivet toward and into the sheets;

a die having a rounded tip portion, a circular platform portion and a lip portion, wherein the tip portion tapers radially inwardly in the direction of the punch, the platform portion forms a relatively flat surface facing the punch for limiting downward deformation of the sheets and the lip portion extends radially outward from the longitudinal axis of the die;

a plurality of blades are assembled around the tip portion and the lip portion, wherein the blades are retained, in part, by the lip portion;

a relief cavity is defined by the die and the plurality of blades, the cavity provides space for local deformation of the sheets; and a blade collar engages the blades for resiliently biasing the blades inwardly towards the tip portion, wherein the punch drives the rivet into the sheets deforming a mating portion of the sheets between the punch and the die into the cavity which causes the blades to move radially outward from the tip portion, and thereby expanding the cavity to reduce reaction force applied by the blades to the mating portion that is deformed into the cavity.

2. An apparatus for riveting two or more sheets together, comprising:

a punch for retaining and driving a self-piercing rivet into the sheets;

a die oriented to oppose the punch, wherein the die defines a base portion having a top surface, an intermediate portion and a rounded tip portion, the intermediate portion is coaxial with and adjacent to the base portion, wherein the intermediate portion has a lip, the rounded tip portion is coaxial with both the intermediate portion and the base portion, wherein the tip portion extends axially from the intermediate portion toward the punch;

a plurality of blades are assembled around the intermediate portion adjacent to the top surface of the base portion, wherein the blades are retained, in part, by the lip of the intermediate portion;

the intermediate portion, the rounded tip portion and the plurality of blades define a circular relief cavity, wherein the cavity provides space for local deformation of the sheets and the rivet; and a blade collar engaging the blades for resiliently biasing the blades inwardly towards the tip portion, wherein the punch drives the rivet into the sheets deforming the rivet and a mating portion of the sheets between the punch and the die into the cavity which causes the blades to move radially outward from the tip portion, and thereby expanding the cavity to reduce the reaction force applied by the blades to the rivet and the mating portion as they are deformed into the cavity.

3. The apparatus of claim 2, wherein the blades are radially disposed around the circular relief cavity and the intermediate portion.

4. The apparatus of claim 2, wherein the top surface of the base portion limits movement of the blades toward the base portion.

5. The apparatus of claim 2, wherein the rounded tip portion of the die includes an external surface tapering radially inwardly along the longitudinal axis of the die in the direction of the punch.

6. The apparatus of claim 5, wherein the external surface of the rounded tip portion is generally in a shape of a cone.

7. The apparatus of claim 2, wherein the intermediate portion of the die includes a radially inwardly extending circular platform portion that is contiguous with and below the rounded tip portion for limiting downward deformation of the sheets.

8. The apparatus of claim 2, wherein the blades have an inner notch that receives the lip of the intermediate portion to retain the blades on the top surface of the base portion.

9. The apparatus of claim 2, wherein the intermediate portion includes a radially beveled recess, wherein the recess receives a radially beveled blade lip of the blades to retain the blades on the top surface of the base portion.

10. The apparatus of claim 9, wherein the base portion and the radially beveled recess of the intermediate portion form a radially beveled channel to receive the blade lip.

11. The apparatus of claim 2, wherein the plurality of blades define an outer notch facing radially outward from the longitudinal axis of the die, wherein the outer notch is disposed above the lip of the intermediate portion to receive the blade collar.

12. The apparatus of claim 2, wherein the circular relief cavity expands down towards the lip of the intermediate portion when the blades move radially outward from the tip portion.

13. The apparatus of claim 2, wherein the blade collar is formed of an elastomeric polymer.

14. The apparatus of claim 2, wherein the blade collar has an upper inner circular surface and a lower inner circular surface for limiting the movement of the blades radially outward from the tip portion, wherein the lower inner circular surface generally tapers radially inward from the longitudinal axis of the blade collar and towards the upper inner circular surface, wherein the upper inner circular surface tapers towards the lower inner circular surface and radially inwardly from the longitudinal axis of the blade collar.

15. The apparatus of claim 2, wherein the punch is attached to a first opposing end of a C-shaped frame and the die is attached to a second opposing end of the C-shaped frame facing the punch.

* * * * *